United States Patent [19]

Murakami et al.

[11] 4,287,004

[45] Sep. 1, 1981

[54] DIP PHOSPHATING PROCESS

[75] Inventors: Ryoichi Murakami; Hideo Shimizu; Syuzi Sato, all of Neyagawa, Japan

[73] Assignee: Nippon Paint Co., Ltd., Osaka, Japan

[21] Appl. No.: 100,409

[22] Filed: Dec. 5, 1979

[51] Int. Cl.[3] ..... C23F 7/08

[52] U.S. Cl. ..... 148/6.15 R; 148/6.15 Z

[58] Field of Search ..... 148/6.15 R, 6.15 Z; 118/304

[56] References Cited

U.S. PATENT DOCUMENTS

| | | | |
|---|---|---|---|
| 2,658,008 | 11/1953 | Williams et al. | 118/304 |
| 3,705,817 | 7/1970 | Durr | 427/435 |
| 4,196,023 | 4/1980 | Rowe | 148/6.15 R |

FOREIGN PATENT DOCUMENTS

| | | | |
|---|---|---|---|
| 7603695 | 2/1976 | Japan | 148/6.15 Z |

*Primary Examiner*—Ralph S. Kendall

*Attorney, Agent, or Firm*—Wenderoth, Lind & Ponack

[57] ABSTRACT

A dip phosphating process, which comprises introducing a substrate to be phosphated into a phosphating bath while undulating the phosphating solution at the entrance section of the bath.

6 Claims, 2 Drawing Figures

DIP PHOSPHATING PROCESS

Figure 1:
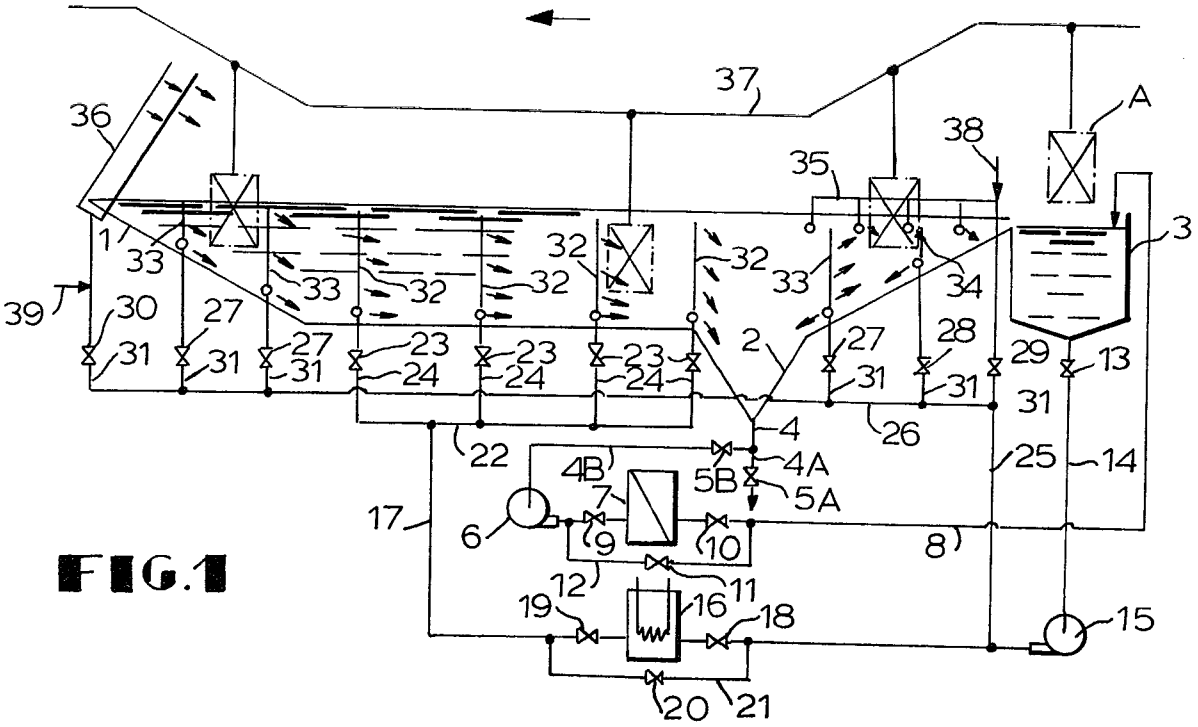

The present invention relates to improvements to a dip phosphating process, which may be adopted for the pre-treatment before coating of a metallic substrate, and an apparatus therefor.

As the pre-treatment before coating of automobiles, home electric appliances, steel furnitures, etc., there is usually adopted phosphating treatment, particularly by the spray process. When, however, the substrate includes spray pockets (i.e. pocket-like recesses), such pocket portions can hardly receive direct spray and have only repellent splashes of the phosphating solution, even in whatever direction the spray nozzle is changed. As the result, only a temper-like phosphating film is formed on the surface. Such phosphating surface has poor corrosion-resistance and inferior adhesion onto the coating subsequently formed and is insufficient as a base for coating. In case of the treatment by the dip process, the substrate can be sufficiently subjected to phosphating even up to the said pocket portions. However, the dip process has such a problem that, due to the irregular conveyance speed of a conveying device for dipping the substrate in a phosphating solution, the phosphated surface involves stepped unevenness of phosphating, and a uniform phosphating film is not obtainable. This point has provided the greatest obstacle to the use of the dip process for phosphating of the large sized objects such as automobiles. Besides, an article having a recess at the bottom surface, e.g. automobile tyrehouse, is apt to make an air pocket at the dipping stage, and such portion is prevented from the sufficient contact with the phosphating solution. Further, the sludge floating in the phosphating solution tends to stick on the substrate and is hardly removed by washing with water.

In recent years, there has come to be employed the spray-dip process utilizing the strong points of both the spray process and the dip process. According to such process, a substrate is first subjected to spray treatment for 5 to 60 seconds and then to dip treatment, and therefore it is effective for preventing faulty phosphating of the pocket portions and stepped unevenness of phosphating. Since, however, the crystal form of the phosphating film is determined at an early stage of phosphating treatment, the phosphating film of such crystal form as is obtainable by the dip process, which shows the better results than the spray process in corrosion resistance and adhesion as a coating base, can not be formed in the spray-dip process.

In order to provide a dip phosphating process which can form a phosphating film having good corrosion resistance and high adhesion property avoiding drawbacks present in conventional dip processes, an extensive study has been carried out. As the result, it has now been found that the provision of the phosphating solution with undulation at the entrance section of the phosphating bath can avoid the occurrence of the stepped unevenness of phosphating and prevent the formation of air pockets. It has also been found that the spray of water or the phosphating solution onto the phosphated substrate which is being taken from or has just been taken from the phosphating bath is effective in washing out easily the sludge stuck on such substrate.

According to the present invention, there is provided a dip phosphating process comprising introducing a substrate to be phosphated into a phosphating bath, dipping the substrate in the bath until the phosphating is accomplished at the surface of the substrate and taking out the phosphated substrate from the bath, characterized in that the introduction of the substrate into the bath is effected while undulating the phosphating solution in the bath at the entrance section of the bath.

As the phosphating bath, there may be employed any conventional one. Preferred is the one of which the section is of ship shape, i.e. consisting of (1) the entrance section which is tapered and gradually deepened to the central section, (2) the central section which constitutes a horizontally flat bottom portion and (3) the exit section which is tapered and gradually shallowed from the central section. Particularly preferred is the one which has a ship shape section and a depressed portion between the entrance section and the central section, which is served as a settling bath for sludge.

For transmitting the substrate to be phosphated, there may be used a conveyer which can so work that the substrate is introduced into the phosphating bath, carried on in the phosphating bath at a dipping state and taken out from the phosphating path.

In order to undulate the phosphating solution, any means which can produce waves at the solution surface without material splash. One of the typical procedures for undulation is to flow water or the phosphating solution into the phosphating bath through the nozzle holes opened at, above or below the solution surface.

The phosphated substrate is preferred to be washed by spraying water or the phosphating solution thereon for removal of the sludge attached thereto. Such washing is effected to the phosphated substrate at the exit section, i.e. the one which is being taken from or has been just taken from the phosphating bath.

In addition, it is preferable to make in the phosphating bath the flow of the phosphating solution from the exit section to the central section, particularly to the settling bath, with or without the flow from the entrance section to the central section, particularly to the settling bath, whereby the movement and settlement of the sludge into the settling bath is accelerated. The said flows can be produced readily, for instance, by spouting water or the phosphating solution through the nozzle holes appropriately set in various places in the phosphating bath.

Usually, the phosphating solution in the phosphating bath is overflowed, and the overflowed phosphating solution is returned or recycled through the said nozzle holes into the phosphating bath. One of the advantageous procedures is to set an overflow tank in front of the entrance section of the phosphating bath so that the overflowed phosphating solution is accumulated therein and returned or recycled through appropriate pipe lines to the phosphating bath, whereby the desired flows of the phosphating solution are produced.

Figure 2:
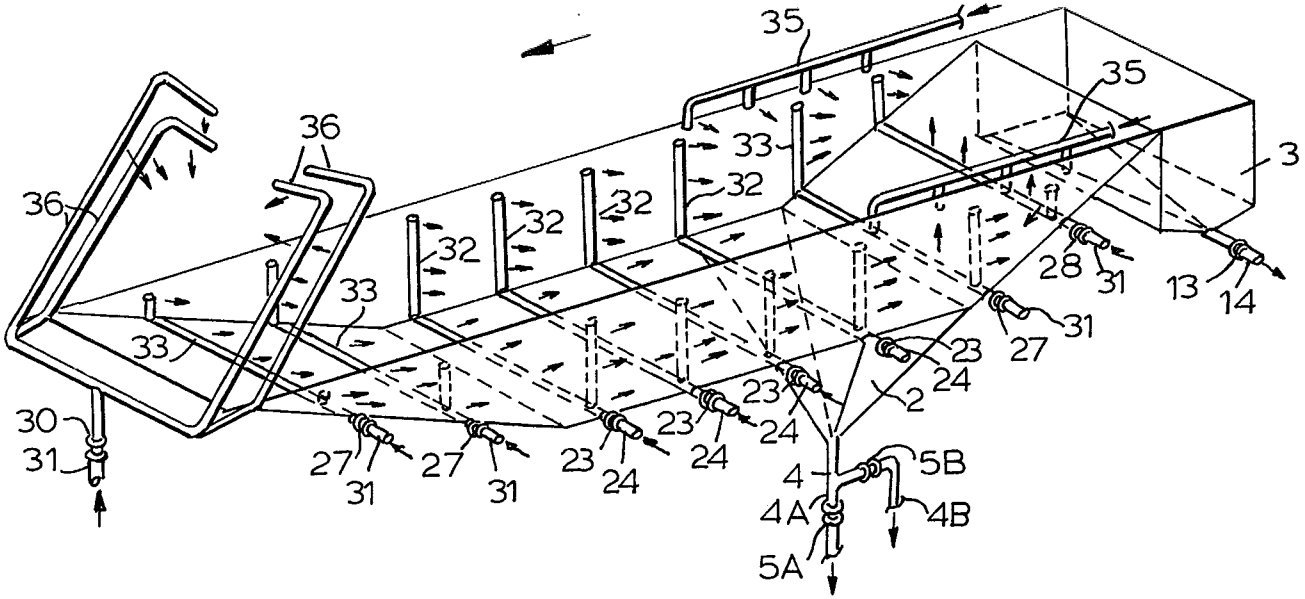

The present invention will be hereinafter illustrated more in detail with reference to the appended drawings wherein:

FIG. 1 is a flow sheet to show an embodiment of the apparatus according to the present invention; and FIG. 2 is a perspective view of the essential part thereof.

In the drawings, 1 is a phosphating bath, 2 is a settling bath provided between the entrance section and the central section of the bath 1, and 3 is an overflow tank provided in front of the entrance section of the bath 1. Alternatively, the overflow tank 3 may be provided behind the exit section or at the lateral side of the bath 1.

At the bottom of the settling bath 2, there is provided a discharge pipe 4, which is branched into a pipe 4A having a valve 5A and a pipe 4B having a valve 5B. The pipe 4B is connected to a pump 6, which is connected to a filter 7 by a pipe 8. At the front and rear parts of the filter 7, there are provided valves 9 and 10. To the pipe 8 is connected a pipe 12 having a valve 11 without passing through the filter 7.

At the bottom of the overflow tank 3, there is provided an outlet pipe 14 with a valve 13, the pipe 14 being connected to a pump 15. To the pump 15, a heat exchanger 16 is connected by a pipe 17, and valves 18 and 19 are provided on the front and rear parts of the heat exchanger 16. To the pipe 17 is connected a pipe 21 having a valve 20 as a detour.

The pipe 17 is connected to a main pipe 22. To the main pipe 22, there are connected branch pipes 24 each having a valve 23. A pipe 25 branched from the pipe 17 is connected to the main pipe 26, to which branch pipes 31 having respectively valves 27, 28, 29 and 30 are provided. As apparent from FIG. 2, the branch pipes 24 and 31 are arranged at a suitable distance on the bottom surface of the phosphating bath 1 and inside the lateral wall, and are connected to risers 32, 33 and 34 which have nozzle holes for spouting. The other part of said branch pipe 31 is arranged at the entrance section of the bath 1 and connected to a riser 35 which has the nozzle hole for spouting. A further part of said branch pipe 31 is disposed on the lateral side at the exit section of the bath 1, and is connected with a riser 36 having the nozzle hole for spouting. 37 is a device for conveyance of a substrate A to be phosphated. 38 and 39 are pipes for supplying water (which may be the water used in the washing step after the phosphating step).

The nozzle holes may be each opened into an appropriate direction so as to make the desired flows of the phosphating solution including the undulation at the entrance section. The arrow marks in FIGS. 1 and 2 indicates an example of the directions of the nozzle holes which are practically applicable.

The phosphating treatment by the use of the apparatus as shown in FIGS. 1 and 2 may be carried out as hereinafter explained.

Firstly, the required amounts of a phosphating solution are supplied to the phosphating bath 1 and the overflow tank 3. Then, the valves 13, 18, 19 and 23 are opened, the pump 15 actuated to spout the phosphating solution in the tank 3 into the bath 1 from the riser 32 through the heat exchanger 16, whereby the phosphating solution in the bath 1 flows into the tank 3. The heat exchanger 16 is a means of maintaining the temperature of the phosphating solution to the required temperature; when heating is not necessary, the valves 18 and 19 may be closed with opening of the valve 20.

When the phosphating solution comes to the required temperature, the valves 27, 28, 29 and 30 are opened, and the phosphating solution is spouted from the risers 33, 34, 35 and 36. Then, by means of the conveying device 37, the substrate A is brought into the bath 1, and phosphating treatment is started.

By the actions of the phosphating solution and/or water spouted through the riser 35, the phosphating solution at the entrance section of the bath 1 is undulated. By this, there can be formed a uniform phosphating film without stepped unevenness of phosphating on the surface of the substrate A. Also, by spouting the phosphating solution upward from the riser 34 on the bottom surface at the entrance section of the bath 1, the phosphating solution is sufficiently allowed to contact the portion where is otherwise not readily phosphated by the development of an air pocket, such as the recess portion on the bottom surface of the substrate A.

Also, by spouting the phosphating solution from the risers 32 and 33, the phosphating solution in the bath 1 is stirred to run into the tank 3. By conveying the substrate A through such phosphating solution, a uniform film of phosphating can be formed.

The substrate A after phosphating treatment is carried to the step of water washing by means of the conveying device 37. In the bath 1, the sludge by-produced in the phosphating treatment is floating, and the sludge so formed is stuck to the substrate A. Before the sludge is firmly deposited, the phosphating solution or water is spouted from the riser 36 to wash and remove the sludge.

By the phosphating treatment, a large quantity of the sludge comprising mainly phosphate compounds is by-produced in the bath 1. The sludge precipitated at the bottom of the bath 1 moves readily by its own gravity and under the spouting action of the phosphating solution from the risers 32 and 33 to fall into the settling bath 2. When the sludge in the settling bath 2 becomes a high concentration, the valves 5B, 9 and 10 are opened to operate the pump 6, by which the above slurry is sent to the filter 7 for separation between the solid and the liquid. The sludge in a solid state is discharged out of the system. The filtrate is returned through the pipe 8 to the overflow tank 3. In an early stage of the treatment (the stage where the sludge is not accumulated in the settling bath 2), the discharge liquid from the settling bath 2 may not be supplied to the filter 7 but be returned to the overflow tank 3 through the pipe 12.

In the phosphating treatment with the present invention, the position of the nozzle holes of the riser 35 may be appropriately selected; in whichever case of spouting the phosphating solution from at, above or below the solution surface, it should not produce material splash to stick to the substrate A. Usually, a range of about 5 to 20 cm above and below the solution surface is suitable. Also, the spouting volume from the riser 35 may be appropriately adjusted by the valve 29 so as to undulate the phosphating solution at the entrance portion of the bath 1. Further, the spouting volume of the riser 34 may be suitably adjusted with the valve 28 to a degree not to cause the substrate A to float up by the upward spouting of the phosphating solution. Besides, the spouting volume of the risers 32 and 33 which take part in the circulation of the phosphating solution in the bath and the movement of the sludge are to be suitably adjusted with the valves 23 and 27, depending on the circulating condition, the amount of the sludge and the property of the slurry in the bath. As a means of making the flows of the phosphating solution in the bath, a draft tube system may be used.

The position of installing the riser 36 may be so arranged as to have the spouting solution applied from the neighborhood of the position where the substrate A is partly exposed from the phosphating solution by the conveying device 37. The spouting amount is appropriately adjusted by the valve 30 so that the sludge deposited on the substrate A can be eliminated. Usually, the spouting pressure may be from 0.8 to 2.0 kg/cm$^2$. With regard to the nozzle of the riser 36, a pipe nozzle which does not make the spouting solution misty (e.g. a pipe of about 10 mm in diameter with its tip tapered) is preferred.

When the phosphating treatment is effected by the invention process and apparatus, it is possible to dissolve the stepped unevenness of phosphating, the defective phosphating of the air pocket portion, the coating defects by dust or sludge adhered to the substrate, etc. and thus to provide excellent phosphating as a coating base.

The present invention is further explained by the following Examples and Comparative Examples, wherein parts and % are by weight unless otherwise indicated.

A test plate of commercially available cold rolled steel (100×300×0.8 mm) was subjected to dip degreasing with a weak alkali degreasing agent (2%) ("RIDOLINE SD200" manufactured by Nippon Paint Co., Ltd.) at a temperature of 60° C. for 2 minutes. The plate was thereafter washed with water and subjected to dipping treatment with a metal surface conditioning agent (0.1%) ("FIXODIN 5N-5" manufactured by Nippon Paint Co., Ltd.) at room temperature for 30 seconds. Then, after the dipping treatment with a phosphating solution (Zn, 0.15%; Ni, 0.04%; $PO_4$, 1.4%; $NO_3$, 0.5%; $ClO_3$, 0.1%; Cl, 0.1%; $NO_2$, 0.0065%) under the condition of a total acidity of 17 points, a free acid degree of 0.9 point, a toner value of 1.5 points and a temperature of 50° C. for 2 minutes, the plate was washed with water and dried.

The conveyance speed of a substrate (i.e. an automobile body) in the automobile coating line is usually 4 to 5 m/min, and dipping of the substrate in a phosphating solution is made with inclination at an angle of 20 to 25 degrees to the solution surface. Therefore, in practicing the above operation, phosphating treatment was effected with adjustment thereto, and the finished appearance of the phosphating film was judged by visual inspection.

The point of the total acidity represents the volume in ml of 0.1 N NaOH required for coloration in red of the sampled 10 ml of the phosphating solution when phenol-phthalein is used as an indicator. The point of the free acid represents the volume in ml of 0.1 N NaOH required coloration into blue of the sampled 10 ml phosphating solution when bromophenol blue is used as an indicator. The point of the toner value represents the volume in ml of 0.042 N $KMnO_4$ for coloration into red of the sampled 25 ml of the phosphating solution with addition of several drops of 50% $H_2SO_4$.

Comparative Example 1

By the use of a conventional zinc phosphating equipment of dip type, phosphating treatment was carried out.

EXAMPLE 1

A zinc phosphating equipment of dip type different from a conventional one in the following respect was used: at the entrance section of the phosphating bath, the nozzle holes of the riser 35 were provided slightly below the surface of the phosphating solution so that the phosphating solution was stirred by undulation under the spouting of the phosphating solution. By the above system, phosphating treatment was effected.

EXAMPLE 2

In addition to the construction of Example 1, the riser 35 was provided to the lateral side at the exit section of the phosphating bath so that the phosphating solution was spouted to the plate which had been just phosphated. By the above system, phosphating treatment was effected.

EXAMPLE 3

In addition to the construction of Example 2, the risers 32, 33 and 34 were arranged at the bottom part and the lateral side so that the phosphating solution was stirred by spouting. By the above system, phosphating treatment was effected.

The results of the above are shown in Table 1.

TABLE 1

| | Appearance of phosphating film | | |
|---|---|---|---|
| | Stepped unevenness | Film quality | Deposited sludge |
| Example 1 | No | Fine | Deposited |
| Example 2 | No | Fine | None |
| Example 3 | No | Fine | None |
| Comparative Example 1 | Present | Rough | Deposited |

EXAMPLE 4

To each of the plates treated under Comparative Example 1 and Examples 1 to 3, a polyester type electrocoating composition ("POWER COAT 9600 K" manufactured by Nippon Paint Co., Ltd.) was applied to make a film thickness of 20 microns, and the coated plate was baked at 170° C. for 30 minutes.

The plate electrocoated as above was subjected to a 5% saline spray test (JIS Z-2371), and the results are shown in Table 2. For peeling off (JIS Z-1522), a cellophane adhesive tape manufactured by Nichiban Company, Ltd. was used.

TABLE 2

| | | Peeling of coating film | | |
|---|---|---|---|---|
| | | After 240 hrs. | After 360 hrs. | After 500 hrs. |
| Example 1 | (A) | Within 1.5 mm | 1.5–2.0 mm | 2.0–3.0 mm |
| | (B) | None | 5 | 10 |
| Example 2 | (A) | Within 1.5 mm | 1.5–2.0 mm | 2.0–2.5 mm |
| | (B) | None | None | None |
| Example 3 | (A) | Within 1.5 mm | 1.5–2.0 mm | 2.0–2.5 mm |
| | (B) | None | None | None |
| Comparative Example 1 | (A) | 1.5–2.0 mm | 2.0–3.0 mm | Tape width |
| | (B) | 15 | 20 | Whole surface |

Note:
(A) Peeling from the cut part
(B) Peeling in spot rust form

What is claimed is:

1. A dip phosphating process, which comprises introducing a substrate to be phosphated into a bath containing a phosphating solution, while undulating, without splashing, the phosphating solution at the entrance section of the bath, wherein the substrate is washed by spouting a phosphating solution and/or water thereto when the substrate is taken out of the phosphating solution in the bath at the exit section.

2. The process according to claim 1 wherein the phosphating solution in the bath is circulated.

3. A dip phosphating process comprising introducing a substrate into a phosphating bath, dipping the substrate in the phosphating solution in the bath until the substrate is phosphated and taking out the phosphated substrate from the phosphating bath, characterized in that the introduction of the substrate into the phosphating bath is carried out while undulating, without splashing, the phosphating solution in the bath at the entrance section of the bath so as to prevent the stepped unevenness of the phosphating and wherein a phosphating solution or water is spouted against the substrate when the substrate is removed from the bath so as to remove any sludge which may have been developed thereupon.

4. The process according to claim 3, wherein the undulation of the phosphating solution is produced by spouting the phosphating solution from nozzle holes.

5. The process according to claim 3, wherein the dipping of the substrate is carried out, while transferring the substrate from the entrance section of the bath to the exit section of the bath.

6. The process according to claim 5, wherein the transfer of the substrate is carried out while spouting the phosphating solution through nozzle holes so as to move any sludge from the exit section of the bath to the central section of the bath.

* * * * *